US012326285B2

(12) United States Patent
Toyooka et al.

(10) Patent No.: US 12,326,285 B2
(45) Date of Patent: Jun. 10, 2025

(54) BINARY REFRIGERATION APPARATUS

(71) Applicant: PHC Holdings Corporation, Tokyo (JP)

(72) Inventors: Takashi Toyooka, Saitama (JP); Minoru Suto, Gunma (JP)

(73) Assignee: PHC HOLDINGS CORPORATION, Tokyo (JP)

( * ) Notice: Subject to any disclaimer, the term of this patent is extended or adjusted under 35 U.S.C. 154(b) by 197 days.

(21) Appl. No.: 18/072,247

(22) Filed: Nov. 30, 2022

(65) Prior Publication Data

US 2023/0093643 A1 Mar. 23, 2023

Related U.S. Application Data

(63) Continuation of application No. PCT/JP2021/018389, filed on May 14, 2021.

(30) Foreign Application Priority Data

Apr. 6, 2020 (JP) ..... 2020-097933

(51) Int. Cl.

| | |
|---|---|
| ***F25B 7/00*** | (2006.01) |
| ***F25B 6/02*** | (2006.01) |
| ***F28D 9/00*** | (2006.01) |

(52) U.S. Cl.

CPC ..... *F25B 7/00* (2013.01); *F25B 6/02* (2013.01); *F28D 9/0031* (2013.01)

(58) Field of Classification Search

CPC .... F25B 7/00; F25B 6/02; F25B 39/00; F25B 40/00; F25B 2400/052; F25B 2400/054; F25B 2500/01; F28D 9/0031; F28D 2021/0068; F28D 7/024; F28D 7/106; F28D 9/0037; F28F 1/025

See application file for complete search history.

(56) References Cited

U.S. PATENT DOCUMENTS 4,788,829 A 12/1988 Takemasa et al.
8,011,201 B2 9/2011 Brown et al.

FOREIGN PATENT DOCUMENTS

CN 106123013 A * 11/2016 ..... F28D 9/0037
EP 2019269 A1 1/2009

(Continued)

OTHER PUBLICATIONS

CN 106123013 A Translation (Year: 2016).*

(Continued)

*Primary Examiner* — Jerry-Daryl Fletcher
*Assistant Examiner* — Dario Antonio Deleon
(74) *Attorney, Agent, or Firm* — Rimon P.C.

(57) ABSTRACT

Provided is a binary refrigeration apparatus including: a low-temperature side refrigeration circuit including a spiral heat exchanger including a main tube and a spiral tube wound around the main tube in a spiral form, the main tube being a tube where a low-temperature side refrigerant that flows into a low-temperature side compressor enters, the spiral tube being a tube where the low-temperature side refrigerant flown out from the low-temperature side compressor enters; and a high-temperature side refrigeration circuit where a high-temperature side refrigerant that exchanges heat with the low-temperature side refrigerant through a plate heat exchanger circulates.

10 Claims, 7 Drawing Sheets

(56) References Cited

FOREIGN PATENT DOCUMENTS

| | | | | | |
|---|---|---|---|---|---|
| JP | 57-199767 | U | | 12/1982 | |
| JP | 62-073046 | A | | 4/1987 | |
| JP | 2012-112615 | A | | 6/2012 | |
| JP | 2013015315 | A | * | 1/2013 | ..... F25B 7/00 |
| JP | 2014196868 | A | * | 10/2014 | ..... F25B 7/00 |
| JP | WO 2015071967 | A1 | * | 5/2015 | ..... F25B 40/02 |

OTHER PUBLICATIONS

WO 2015071967 A1 Translation (Year: 2015).*
JP 2014196868 A Translation (Year: 2014).*
JP 2013015315 A Translation (Year: 2013).*
International Search Report dated Jul. 13, 2021 issued in International Patent Application No. PCT/JP2021/018389, with English translation.
The Extended European Search Report issued in European Patent Application No. 21816648.6, dated Sep. 11, 2023.

* cited by examiner

BINARY REFRIGERATION APPARATUS

CROSS-REFERENCE OF RELATED APPLICATIONS

This application is a Continuation of International Patent Application No. PCT/JP2021/018389, filed on May 14, 2021, which in turn claims the benefit of Japanese Patent Application No. 2020-097933, filed on Jun. 4, 2020, the entire disclosures of which Applications are incorporated by reference herein.

TECHNICAL FIELD

The present disclosure relates to a binary refrigeration apparatus.

BACKGROUND ART

PTL 1 discloses a binary refrigeration circuit including a cascade capacitor that exchanges heat between a high-temperature side refrigerant flowing through a high-temperature side refrigeration circuit and a low-temperature side refrigerant flowing through a low-temperature side refrigeration circuit. The cascade capacitor disclosed in PTL 1 is a plate heat exchanger.

CITATION LIST

Patent Literature

PTL 1
U.S. Pat. No. 8,011,201

SUMMARY OF INVENTION

Technical Problem

For binary refrigeration circuits, there is a demand for improvement in heat exchange efficiency in the plate heat exchanger.

To solve the problems, an object of the present disclosure is to provide a binary refrigeration circuit that can improve the heat exchange efficiency in a plate heat exchanger.

Solution to Problem

To achieve the above-mentioned object, a binary refrigeration apparatus the present disclosure includes: a low-temperature side refrigeration circuit including a spiral heat exchanger including a main tube and a spiral tube wound around the main tube in a spiral form, the main tube being a tube where a low-temperature side refrigerant that flows into a low-temperature side compressor enters, the spiral tube being a tube where the low-temperature side refrigerant flown out from the low-temperature side compressor enters; and a high-temperature side refrigeration circuit where a high-temperature side refrigerant that exchanges heat with the low-temperature side refrigerant through a plate heat exchanger circulates.

In addition, to achieve the above-mentioned object, a binary refrigeration apparatus the present disclosure includes: a low-temperature side refrigeration circuit including a double-tube heat exchanger including a multi-petal tube formed in a tubular shape with a wave shape in a cross section orthogonal to an axis line and an outer tube formed in a tubular shape for housing the multi-petal tube inside, the multi-petal tube being a tube where a low-temperature side refrigerant flown out from a low-temperature side compressor enters, the outer tube being a tube where the low-temperature side refrigerant that flows into the low-temperature side compressor enters between an inner peripheral surface of the outer tube and an outer peripheral surface of the multi-petal tube; and a high-temperature side refrigeration circuit where a high-temperature side refrigerant that exchanges heat with the low-temperature side refrigerant through a plate heat exchanger circulates.

Advantageous Effects of Invention

The binary refrigeration apparatus according to an aspect of the present disclosure can improve the heat exchange efficiency in a plate heat exchanger.

DESCRIPTION OF EMBODIMENTS

First Embodiment

Binary refrigeration apparatus 1 of a first embodiment of the present disclosure is described below with reference to the drawings. Binary refrigeration apparatus 1 is provided in freezer 2 (FIG. 5) such as an ultra-low-temperature freezer where the inner temperature of the storage is −80° C. or below, for example.

Figure 1:
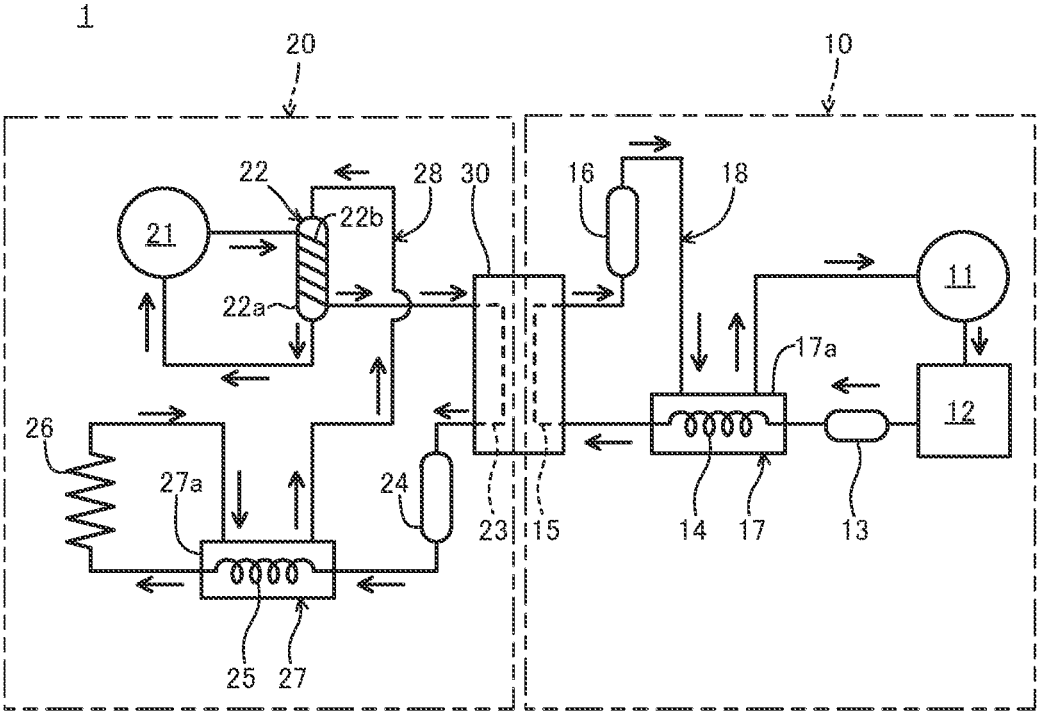
FIG. 1 is a schematic view illustrating a binary refrigeration apparatus of a first embodiment of the present disclosure.

As illustrated in FIG. 1, binary refrigeration apparatus 1 includes high-temperature side refrigeration circuit 10 and low-temperature side refrigeration circuit 20.

High-temperature side refrigeration circuit 10 includes high-temperature side compressor 11, high-temperature side condenser 12, high-temperature side dryer 13, high-temperature side decompressor 14, high-temperature side evaporator 15, liquid receiver 16 and high-temperature side heat exchanger 17.

High-temperature side heat exchanger 17 is composed of a double tube. The inner tube of high-temperature side heat exchanger 17 is high-temperature side decompressor 14. In addition, high-temperature side evaporator 15 makes up plate heat exchanger 30 described later. Liquid receiver 16 is formed in a cylindrical shape.

The above-described apparatuses are connected by high-temperature side pipe 18 so that a high-temperature side refrigerant ejected from high-temperature side compressor 11 returns back to high-temperature side compressor 11. High-temperature side pipe 18 is an example of "pipe".

The high-temperature side refrigerant circulates in the arrow direction illustrated in FIG. 1. More specifically, the high-temperature side refrigerant returns to high-temperature side compressor 11 after flowing through high-temperature side compressor 11, high-temperature side condenser 12, high-temperature side dryer 13, high-temperature side decompressor 14, high-temperature side evaporator 15, liquid receiver 16 and outer pipe 17*a* of high-temperature side heat exchanger 17, in this order.

Low-temperature side refrigeration circuit 20 includes low-temperature side compressor 21, spiral heat exchanger 22, low-temperature side condenser 23, low-temperature side dryer 24, low-temperature side decompressor 25, low-temperature side evaporator 26 and low-temperature side heat exchanger 27. Low-temperature side dryer 24 is an example of "dryer". Low-temperature side dryer 24 is formed in a cylindrical shape. Spiral heat exchanger 22 includes main tube 22*a* and spiral tube 22*b*.

Main tube 22*a* is formed in a cylindrical shape through which the low-temperature side refrigerant flows inside. Main tube 22*a* is disposed such that the axis line direction of main tube 22*a* is set along the up-down direction.

Spiral tube 22*b* is wound around main tube 22*a* in a spiral form such that the low-temperature side refrigerant flows from the upper side toward the lower side of main tube 22*a*. Spiral tube 22*b* is formed in a rectangular shape in cross section.

Low-temperature side heat exchanger 27 is composed of a double tube. The inner tube of low-temperature side heat exchanger 27 is low-temperature side decompressor 25. In addition, low-temperature side condenser 23 makes up plate heat exchanger 30 described later.

The above-described apparatuses are connected by low-temperature side pipe 28 such that the low-temperature side refrigerant ejected from low-temperature side compressor 21 returns back to low-temperature side compressor 21. Low-temperature side pipe 28 is an example of "pipe".

The low-temperature side refrigerant circulates in the arrow direction illustrated in FIG. 1. More specifically, the low-temperature side refrigerant returns to low-temperature side compressor 21 after flowing through low-temperature side compressor 21, spiral tube 22*b*, low-temperature side condenser 23, low-temperature side dryer 24, low-temperature side decompressor 25, low-temperature side evaporator 26, outer pipe 27*a* of low-temperature side heat exchanger 27, and main tube 22*a*, in this order. Note that through the refrigeration cycle in low-temperature side refrigeration circuit 20, an ultra-low temperature of −80° C. or below is obtained in low-temperature side evaporator 26.

Figure 2:
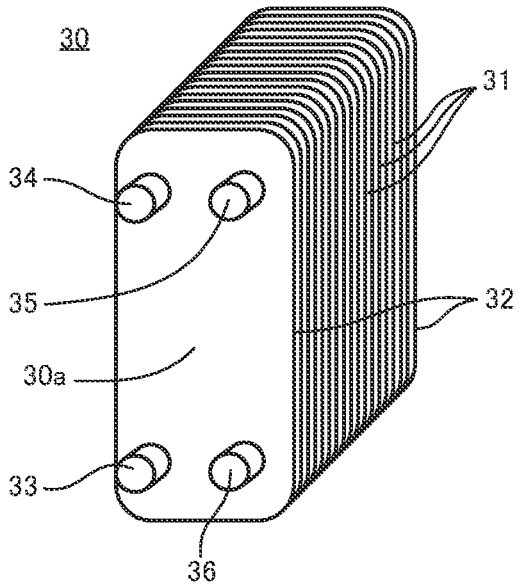
FIG. 2 is a perspective view illustrating a plate heat exchanger illustrated in FIG. 1.

Plate heat exchanger 30 exchanges heat between the high-temperature side refrigerant flowing through high-temperature side evaporator 15 and the low-temperature side refrigerant flowing through low-temperature side condenser 23. As illustrated in FIG. 2, plate heat exchanger 30 is formed in a cuboid shape.

Plate heat exchanger 30 includes a plurality of heat transfer plates 31 and cover plate 32. Heat transfer plate 31 and cover plate 32 are plate members with rectangular shapes in front view. Heat transfer plate 31 is formed in a wave shape in cross section.

The plurality of heat transfer plates 31 is stacked with a predetermined distance therebetween such that a channel through which one of the high-temperature side refrigerant and the low-temperature side refrigerant flows is formed between heat transfer plates 31 adjacent to each other. A high-temperature side channel (not illustrated in the drawing) through which the high-temperature side refrigerant flows and a low-temperature side channel (not illustrated in the drawing) of the low-temperature side refrigerant are formed next to each other with a single heat transfer plate 31 therebetween. That is, the high-temperature side channel and the low-temperature side channel alternate in the stacking direction of the plurality of heat transfer plates 31. Further, cover plate 32 is disposed at each of the both ends of the stack of the plurality of heat transfer plates 31.

High-temperature side inflow part 33 where the high-temperature side refrigerant enters, high-temperature side outflow part 34 where the high-temperature side refrigerant flows out, low-temperature side inflow part 35 where the low-temperature side refrigerant enters and low-temperature side outflow part 36 are disposed at the plate surface of one cover plate 32. The plate surface of cover plate 32 where high-temperature side inflow part 33 and the like are disposed is set as first surface 30*a* of plate heat exchanger 30.

The high-temperature side refrigerant entered from high-temperature side inflow part 33 flows through the high-temperature side channel and flows out from high-temperature side outflow part 34. The low-temperature side refrigerant entered from low-temperature side inflow part 35 flows through the low-temperature side channel and flows out from low-temperature side outflow part 36.

The high-temperature side refrigerant and the low-temperature side refrigerant exchange heat through heat transfer plate 31. In addition, the heat exchange between the high-temperature side refrigerant and the low-temperature side refrigerant is more efficiently performed because heat transfer plate 31 is formed in a wave shape in cross section, which generates turbulent flow of the high-temperature side refrigerant and the low-temperature side refrigerant.

Figure 3:
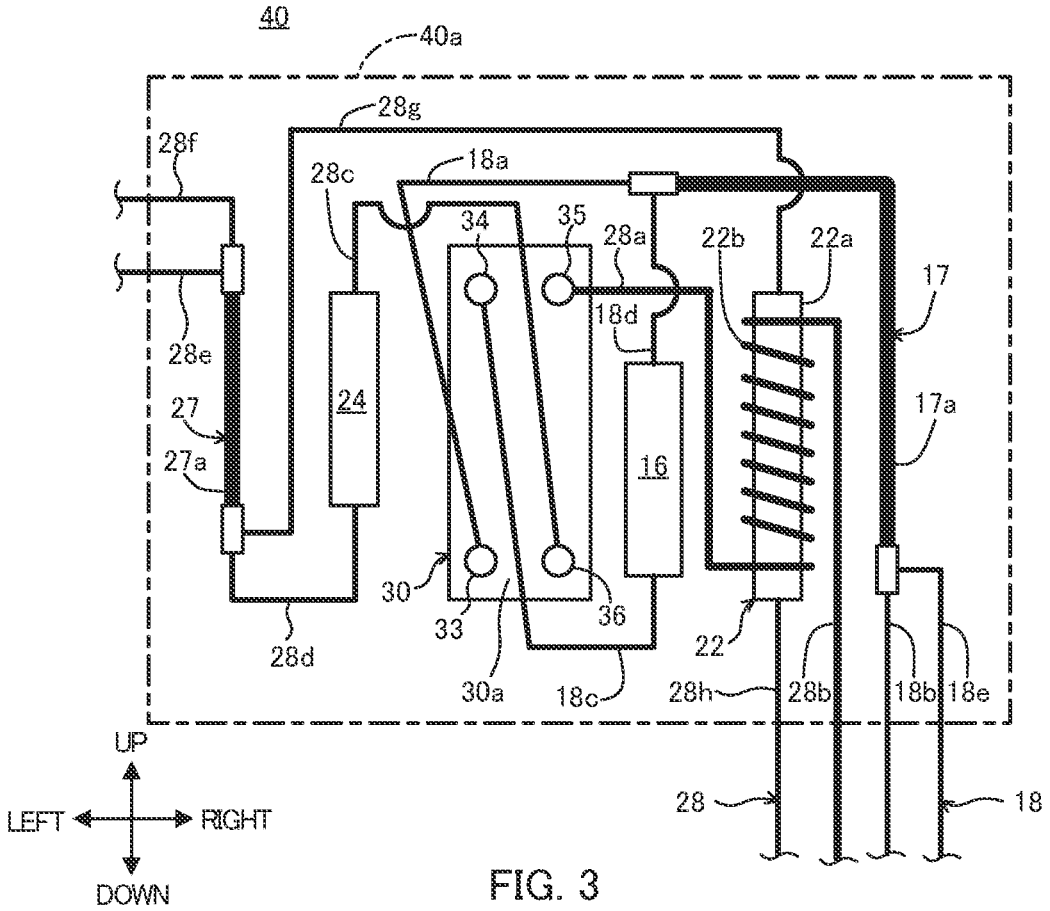
FIG. 3 is a diagram illustrating a configuration of a heat exchanging unit of the first embodiment.
Figure 4:
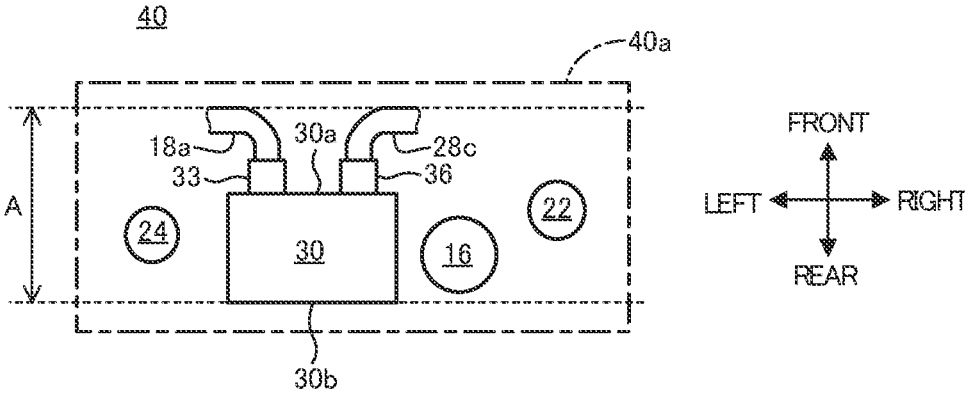
FIG. 4 is a diagram illustrating an arrangement of apparatuses making up the heat exchanging unit illustrated in FIG. 3.

In addition, some apparatuses making up binary refrigeration apparatus 1 make up heat exchanging unit 40 illustrated in FIGS. 3 and 4. Note that hereafter, for convenience of the following description, the upper and lower sides in FIG. 3 are the upper and lower sides of heat exchanging unit 40, respectively. Likewise, the left and right sides are the left and right sides of heat exchanging unit 40, respectively. Likewise, the near and far sides in the drawing are the front and rear sides of heat exchanging unit 40, respectively.

Heat exchanging unit 40 includes plate heat exchanger 30, high-temperature side heat exchanger 17, liquid receiver 16, spiral heat exchanger 22, low-temperature side dryer 24, and low-temperature side heat exchanger 27.

Plate heat exchanger 30 is disposed such that the longitudinal direction is set along the up-down direction and that first surface 30*a* faces the front side.

High-temperature side heat exchanger 17 is disposed on the right side of plate heat exchanger 30. Liquid receiver 16 is disposed between plate heat exchanger 30 and high-temperature side heat exchanger 17 such that the longitudinal direction is set along the up-down direction.

Spiral heat exchanger 22 is disposed between liquid receiver 16 and high-temperature side heat exchanger 17 such that the axis line of main tube 22*a* is set along the up-down direction. Low-temperature side dryer 24 is disposed on the left side of plate heat exchanger 30 such that the longitudinal direction is set along the up-down direction. Low-temperature side heat exchanger 27 is disposed on the left side of low-temperature side dryer 24.

In addition, heat exchanging unit 40 includes a part of high-temperature side pipe 18 and a part of low-temperature side pipe 28 connected to the above-described components.

More specifically, the part of high-temperature side pipe 18 is first to fifth high-temperature side pipes 18*a* to 18*e*. First high-temperature side pipe 18*a* is a pipe that connects high-temperature side inflow part 33 of plate heat exchanger 30 and the inner tube (high-temperature side decompressor 14) of high-temperature side heat exchanger 17. Second high-temperature side pipe 18*b* is a portion, on high-temperature side heat exchanger 17 side, of a pipe that connects the inner tube of high-temperature side heat exchanger 17 and high-temperature side condenser 12.

Third and fourth high-temperature side pipes 18*c* and 18*d* are pipes that are connected to liquid receiver 16. Fifth high-temperature side pipe 18*e* is a portion, on outer pipe 17*a* side of high-temperature side heat exchanger 17, of a pipe that connects outer pipe 17*a* of high-temperature side heat exchanger 17 and high-temperature side compressor 11.

More specifically, the part of low-temperature side pipe 28 is first to eighth low-temperature side pipes 28*a* to 28*h*. First low-temperature side pipe 28*a* is a pipe that connects low-temperature side inflow part 35 of plate heat exchanger 30 and spiral tube 22*b*. Second low-temperature side pipe 28*b* is a portion, on spiral tube 22*b* side, of a pipe that connects spiral tube 22*b* and low-temperature side compressor 21.

Third and fourth low-temperature side pipes 28*c* and 28*d* are pipes connected to low-temperature side dryer 24. Fifth and sixth low-temperature side pipes 28*e* and 28*f* are portions, on the low-temperature side heat exchanger 27 side, of a pipe that connects low-temperature side heat exchanger 27 and low-temperature side evaporator 26. Seventh low-temperature side pipe 28*g* is a pipe that connects outer pipe 27*a* of low-temperature side heat exchanger 27 and main tube 22*a*. Eighth low-temperature side pipe 28*h* is a portion, on main tube 22*a* side, of a pipe that connects main tube 22*a* and low-temperature side compressor 21.

In addition, heat exchanging unit 40 is formed such that the length A in a predetermined direction is suppressed. The predetermined direction is a direction perpendicular to the up-down direction. More specifically, the predetermined direction is a direction orthogonal to first surface 30*a*, i.e., the front-rear direction. The length A in the predetermined direction is a length from second surface 30*b* of plate heat exchanger 30 opposite to first surface 30*a* to the front end of the pipe connected to high-temperature side inflow part 33 and the like disposed at first surface 30*a*, for example.

The pipe connected to plate heat exchanger 30 is bent such that the length A in the predetermined direction is suppressed. Within the range of the length A in the predetermined direction, the above-described spiral heat exchanger 22 and the like are disposed, and a part of high-temperature side pipe 18 and a part of low-temperature side pipe 28 are laid out.

Heat exchanging unit 40 further includes heat insulating member 40*a* that covers each component. Heat insulating member 40*a* is formed of urethane foam, for example. The outer shape of this heat insulating member 40*a* is formed in a cuboid shape. A part of high-temperature side pipe 18 and low-temperature side pipe 28 are output from the lower surface and the left surface of heat insulating member 40*a*.

Figure 5:
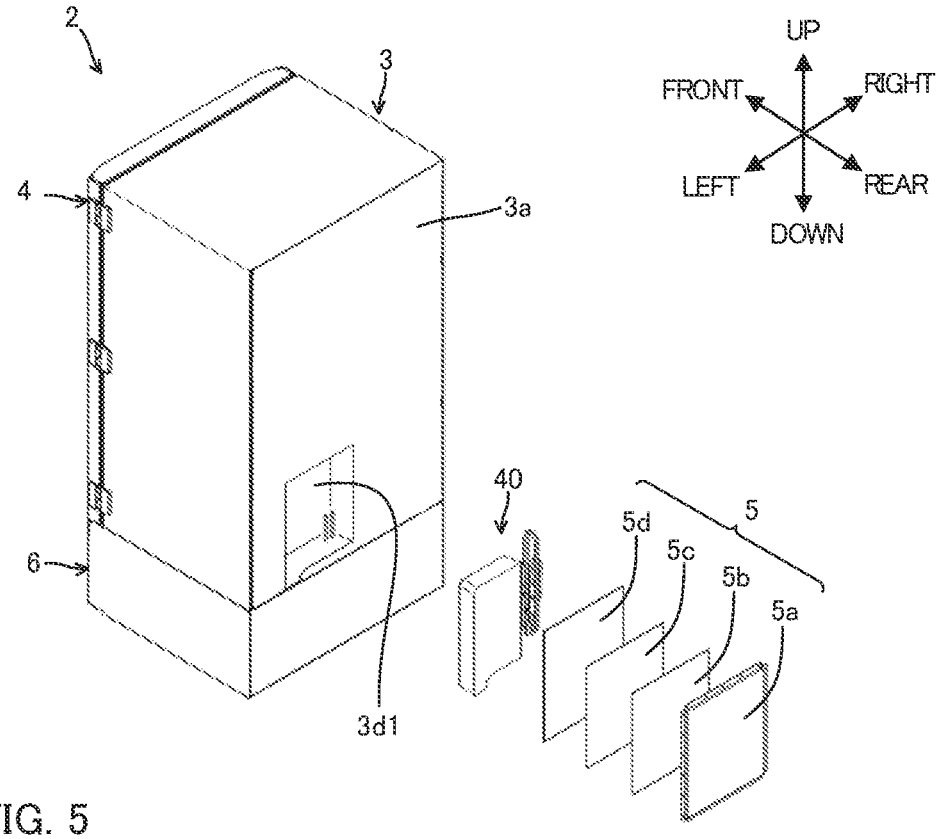
FIG. 5 is a schematic view illustrating a freezer where the binary refrigeration apparatus illustrated in FIG. 1 is used.
Figure 6:
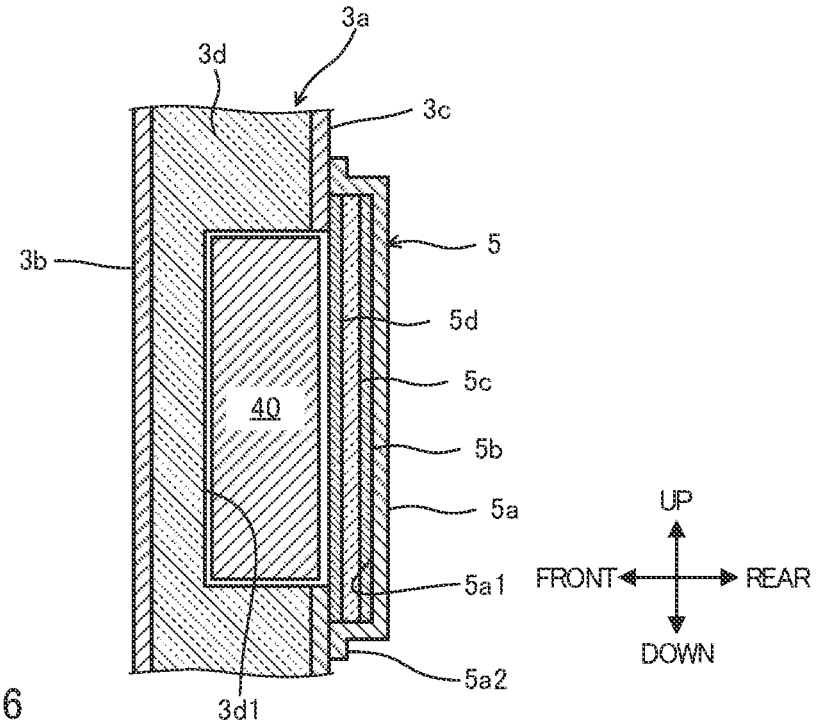
FIG. 6 is a partially enlarged sectional view illustrating a rear side wall of a box illustrated in FIG. 5.

Next, the arrangement of heat exchanging unit 40 in freezer 2 where binary refrigeration apparatus 1 is used is described below with reference to FIGS. 5 and 6. Note that hereafter, for convenience of the following description, the upper and lower sides in FIG. 5 are the upper and lower sides of freezer 2, respectively. Likewise, the left upper side and the lower right side are the front and rear sides of freezer 2, respectively. Likewise, the left lower side and the upper right side are the left and right sides of freezer 2, respectively.

Freezer 2 includes box 3 with an opening (not illustrated in the drawing) formed on the front side, door 4 that covers the opening of box 3 in an openable and closable manner, lid member 5, and machine chamber 6. Box 3 includes rear side wall 3*a*. Rear side wall 3*a* is an example of "side wall".

Box 3 includes inner case 3*b* composed of an iron plate, outer case 3*c* composed of an iron plate and disposed outside inner case 3*b* with a distance therebetween, and heat insulating layer 3*d* formed by foam-filling urethane foam between inner case 3*b* and outer case 3*c*. In rear side wall 3*a*, housing part 3*d*1 for housing heat exchanging unit 40 is formed. Housing part 3*d*1 is formed in such a manner that outer case 3*c* opens and that heat insulating layer 3*d* is depressed.

Lid member 5 covers housing part 3*d*1. Lid member 5 is detachably attached to the back surface of box 3. Lid member 5 includes cover panel 5*a*, first sheet 5*b*, heat insulating panel 5*c* and second sheet 5*d*.

Cover panel 5*a* is composed of an iron plate with a rectangular shape in front view. In cover panel 5*a*, recess 5*al* depressed from the front side toward the rear side in such a manner that first sheet 5*b*, heat insulating panel 5*c* and second sheet 5*d* can be installed inside. In addition, at the peripheral portion of cover panel 5*a*, flange part 5*a*2 for attaching lid member 5 to rear side wall 3*a* with a screw is formed, for example.

First sheet 5*b*, heat insulating panel 5*c* and second sheet 5*d* are disposed in this order in recess 5*al*. First sheet 5*b* is a flexible sheet formed of polyethylene, and bonded to the bottom surface of recess 5*al*, for example. Heat insulating panel 5*c* is a plate-shaped vacuum heat insulation material whose exterior surface is sealed with a resin film, a metal film and/or the like, and is bonded to first sheet 5*b*, for example. Second sheet 5*d* is a flexible sheet formed of polyethylene, and bonded to heat insulating panel 5*c*, for example.

Heat exchanging unit 40 is housed in housing part 3*d*1 such that the up-down direction of heat exchanging unit 40 is set along the up-down direction of freezer 2, and that the front or rear side of heat exchanging unit 40 faces the front side of freezer 2.

Machine chamber 6 is disposed to support box 3. In machine chamber 6, compressors 11 and 21, condensers 12 and 23 and the like that make up a part of high-temperature side refrigeration circuit 10 and low-temperature side refrigeration circuit 20 of binary refrigeration apparatus 1 are disposed.

Next, a flow of the low-temperature side refrigerant in spiral tube 22*b* of spiral heat exchanger 22 is described. As described above, the low-temperature side refrigerant flown out from low-temperature side compressor 21 enters spiral tube 22*b*.

As described above, spiral tube 22*b* is wound around main tube 22*a* from the upper side to the lower side (FIG. 3). As such, the low-temperature side refrigerant entered into spiral tube 22*b* flows downward along the up-down direction in a spiral manner. When the low-temperature side refrigerant flows in the above-described manner, turbulent flow of the low-temperature side refrigerant is generated. Further, the length of spiral tube 22*b*, the spiral curvature of spiral tube 22*b*, and the number of turns of spiral tube 22*b* are set to facilitate the generation of turbulent flow. In addition, the cross-sectional shape of spiral tube 22*b* is formed in a rectangular shape that facilitates the generation of turbulent flow. The turbulent flow of the low-temperature side refrigerant enters plate heat exchanger 30.

According to the first embodiment, binary refrigeration apparatus 1 includes low-temperature side refrigeration circuit 20 including spiral heat exchanger 22 including main tube 22*a* where the low-temperature side refrigerant that enters low-temperature side compressor 21 enters, and spiral tube 22*b* wound around main tube 22*a* in a spiral form where the low-temperature side refrigerant flown out from low-temperature side compressor 21 enters, and high-temperature side refrigeration circuit 10 where the high-temperature side refrigerant that exchanges heat with the low-temperature side refrigerant through plate heat exchanger 30 circulates.

In this manner, the low-temperature side refrigerant whose flow is set to turbulent flow by flowing through spiral tube 22*b* enters plate heat exchanger 30. In the case where the flow of the fluid is turbulent flow, the heat exchange efficiency is improved in comparison with the case where it is laminar flow. Thus, the heat exchange efficiency in plate heat exchanger 30 is improved.

In addition, main tube 22*a* is disposed such that the axis line direction of main tube 22*a* is set along the up-down direction. In addition, spiral tube 22*b* is wound such that the low-temperature side refrigerant flows from the upper side toward the lower side of main tube 22*a*.

In this manner, the low-temperature side refrigerant flows through spiral tube 22*b* downward along the up-down direction, and thus the generation of the turbulent flow of the low-temperature side refrigerant is facilitated. Thus, the heat exchange efficiency in plate heat exchanger 30 is further improved.

In addition, the portion where the low-temperature side refrigerant flows in spiral tube 22*b* is formed in a rectangular shape in cross section.

In this manner, the generation of the turbulent flow of the low-temperature side refrigerant is facilitated. Thus, the heat exchange efficiency in plate heat exchanger 30 is further improved.

In addition, heat exchanging unit 40 is configured with plate heat exchanger 30, spiral heat exchanger 22, and the part of high-temperature side pipe 18 and the part of low-temperature side pipe 28 disposed at the periphery of plate heat exchanger 30 and spiral heat exchanger 22. Heat exchanging unit 40 is formed such that the length A in the predetermined direction is suppressed.

In this manner, plate heat exchanger 30 and spiral heat exchanger 22 can be unitized such that the length A in the predetermined direction is small. Thus, the degree of freedom of the layout of heat exchanging unit 40 can be improved.

In addition, plate heat exchanger 30 is formed in a cuboid shape, and high-temperature side pipe 18 and low-temperature side pipe 28 are connected to first surface 30*a*. The predetermined direction is a direction orthogonal to first surface 30*a*.

In this manner, in the direction orthogonal to first surface 30*a*, the length of heat exchanging unit 40 can be suppressed.

In addition, binary refrigeration apparatus 1 further includes liquid receiver 16 where the high-temperature side refrigerant flown out from plate heat exchanger 30 enters, and low-temperature side dryer 24 where the low-temperature side refrigerant flown out from plate heat exchanger 30 enters. Heat exchanging unit 40 further includes liquid receiver 16 and low-temperature side dryer 24.

In this manner, heat exchanging unit 40 can suppress the length A in the predetermined direction even in the case where liquid receiver 16 and low-temperature side dryer 24 are provided.

In addition, heat exchanging unit 40 is covered with heat insulating member 40*a* and housed in rear side wall 3*a* of box 3 in freezer 2 where binary refrigeration apparatus 1 is used.

In this manner, in comparison with the case where heat exchanging unit 40 is housed in machine chamber 6, the thermal influence of the components of binary refrigeration apparatus 1 housed in machine chamber 6 on heat exchanging unit 40 can be suppressed.

Second Embodiment

Figure 7:
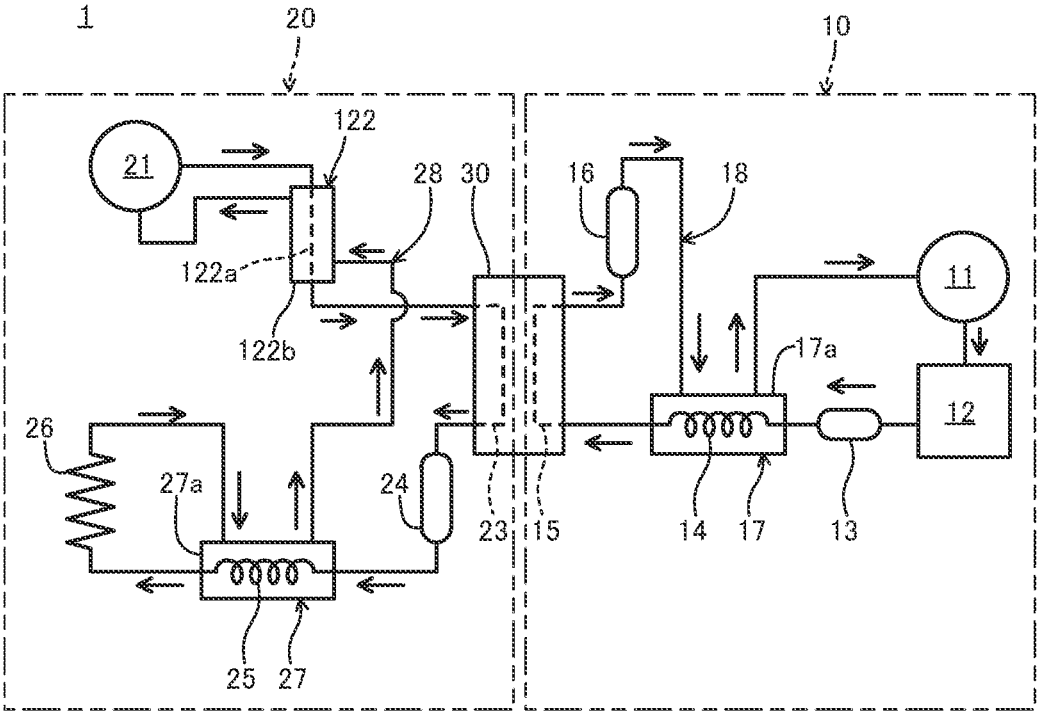
FIG. 7 is a schematic view illustrating a binary refrigeration apparatus of a second embodiment of the present disclosure.

Next, a second embodiment of the present disclosure is described mainly about differences from the above-described first embodiment. In this second embodiment, double-tube heat exchanger 122 illustrated in FIG. 7 is provided instead of spiral heat exchanger 22 of the first embodiment. Double-tube heat exchanger 122 includes multi-petal tube 122*a* and outer tube 122*b*.

Figure 8:
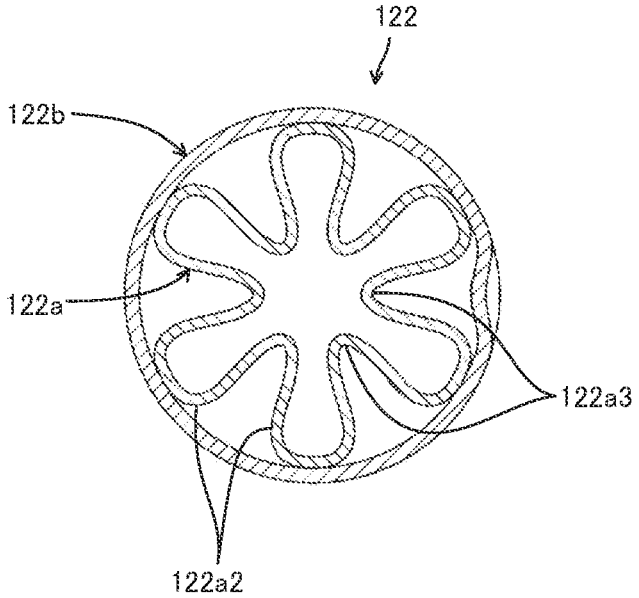
FIG. 8 is a sectional view illustrating a double-tube heat exchanger illustrated in FIG. 7.
Figure 9:
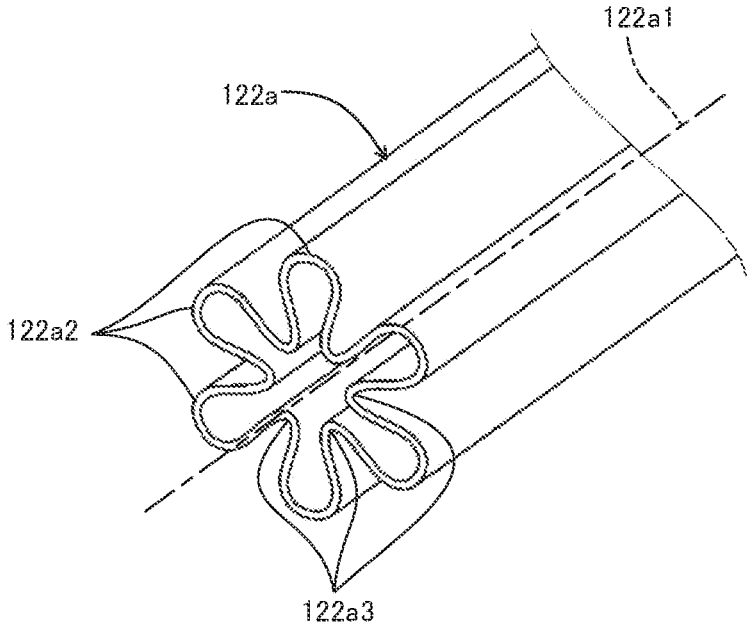
FIG. 9 is a perspective view schematically illustrating a multi-petal tube illustrated in FIG. 8.

Multi-petal tube 122*a* is formed in a tubular shape with a wave shape in the cross section orthogonal to axis line 122*al* (FIGS. 8 and 9). The side wall of multi-petal tube 122*a* is formed such that a waveform in which peak 122*a*2 and valley 122*a*3 alternate in the circumferential direction extends straight along the direction of axis line 122*al* (FIGS. 8 and 9).

Figure 10:
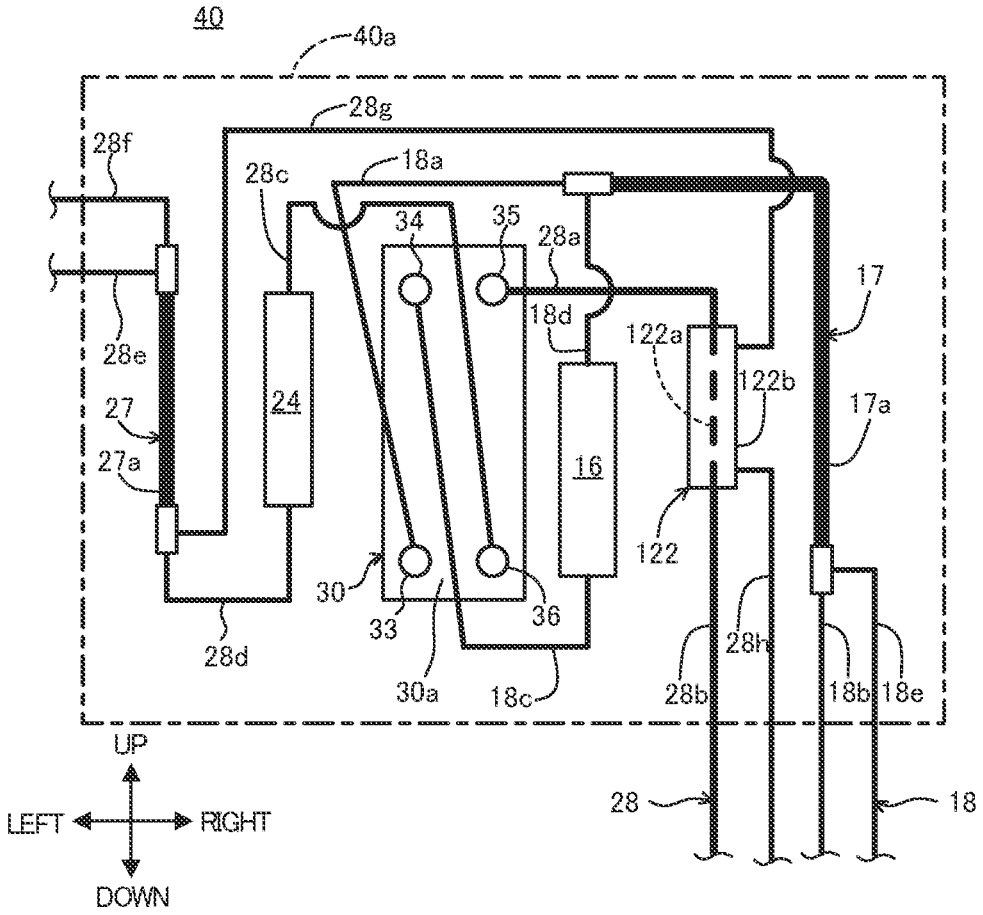
FIG. 10 is a diagram illustrating a configuration of a heat exchanging unit of the second embodiment.

The first end of multi-petal tube 122*a* is connected to low-temperature side compressor 21 through second low-temperature side pipe 28*b* (FIG. 10). The second end of multi-petal tube 122*a* is connected to low-temperature side inflow part 35 of plate heat exchanger 30 through first low-temperature side pipe 28*a*. That is, the low-temperature side refrigerant flown out from low-temperature side compressor 21 enters multi-petal tube 122*a*. The low-temperature side refrigerant flown out from multi-petal tube 122*a* enters low-temperature side inflow part 35 of plate heat exchanger 30.

Outer tube 122*b* is formed in a tubular shape for housing multi-petal tube 122*a* inside (FIG. 8). The first end portion of outer tube 122*b* is connected to outer pipe 27*a* of low-temperature side heat exchanger 27 through seventh low-temperature side pipe 28*g* (FIG. 10). The second end portion of outer tube 122*b* is connected to low-temperature side compressor 21 through eighth low-temperature side pipe 28*h*.

That is, the low-temperature side refrigerant flown out from outer pipe 27*a* of low-temperature side heat exchanger 27 enters outer tube 122*b*. The low-temperature side refrigerant entered into outer tube 122*b* flows between the inner peripheral surface of outer tube 122*b* and the outer peripheral surface of multi-petal tube 122*a*. The low-temperature side refrigerant flown out from outer tube 122*b* enters low-temperature side compressor 21.

In double-tube heat exchanger 122, the heat is exchanged between the low-temperature side refrigerant flowing through multi-petal tube 122*a* and the low-temperature side refrigerant flowing through outer tube 122*b*. Multi-petal tube 122*a*, which has a wavy cross-sectional shape as described above, has a larger area of the exterior surface than the case of a circular cross-sectional shape. Thus, the heat exchange in double-tube heat exchanger 122 is more efficiently performed. In addition, double-tube heat exchanger 122 is disposed such that axis line 122*al* of multi-petal tube 122*a* is set along the up-down direction in the heat exchanging unit.

According to the second embodiment, binary refrigeration apparatus 1 includes low-temperature side refrigeration circuit 20 including double-tube heat exchanger 122 including multi-petal tube 122*a* formed in a tubular shape with a wave shape in the cross section orthogonal to axis line 122*al* and outer tube 122*b* formed in a tubular shape for housing multi-petal tube 122*a* inside, and high-temperature side refrigeration circuit 10 where the high-temperature side refrigerant that exchanges heat with the low-temperature side refrigerant through plate heat exchanger 30 circulates. Multi-petal tube 122*a* is a tube where the low-temperature side refrigerant flown out from low-temperature side compressor 21 enters. The low-temperature side refrigerant that enters low-temperature side compressor 21 enters between the inner peripheral surface of outer tube 122*b* and the outer peripheral surface of multi-petal tube 122*a*.

In this manner, since the inner tube of double-tube heat exchanger 122 is multi-petal tube 122*a*, the generation of the turbulent flow of the low-temperature side refrigerant is more facilitated than the case where the inner tube is a cylinder tube. Thus, the heat exchange efficiency in plate heat exchanger 30 is improved. In addition, since the inner tube of double-tube heat exchanger 122 is multi-petal tube 122*a*, the heat exchange can be more efficiently performed. Thus, the length of multi-petal tube 122*a* in the direction along axis line 122*al* can be shortened, and downsizing of double-tube heat exchanger 122 can be achieved.

Modification

While binary refrigeration apparatus 1 according to one or a plurality of aspects are described above based on the embodiments, the present disclosure is not limited to the embodiments. As long as it does not depart from the main purpose of this disclosure, various variations that one skilled in the art can conceive of on the present embodiment, or forms constructed by combining components in different forms, may also be included within the scope of one or more aspects.

While, in the above-described first embodiment, spiral tube 22*b* has a rectangular cross-sectional shape, the shape may be a circular shape.

Figure 11:
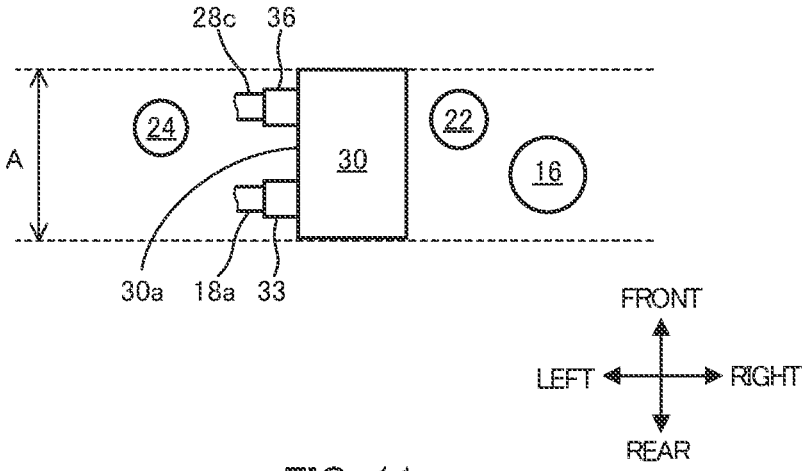
FIG. 11 is a diagram illustrating an arrangement of apparatuses making up a heat exchanging unit of a binary refrigeration apparatus of a modification of the first embodiment of the present disclosure.

In addition, while, in the above-described first embodiment, the predetermined direction is the direction orthogonal to first surface 30*a*, the direction may be the width direction of first surface 30*a*. As illustrated in FIG. 11, the width direction of first surface 30*a* is the front-rear direction when first surface 30*a* of plate heat exchanger 30 faces the left side. In addition, low-temperature side dryer 24 is disposed on the left side of plate heat exchanger 30. Spiral heat exchanger 22 and liquid receiver 16 are disposed on the right of plate heat exchanger 30. In the case where the lengths of low-temperature side dryer 24, spiral heat exchanger 22 and liquid receiver 16 in the front-rear direction and the layout of pipes 18 and 28 are within the length of first surface 30*a* in the width direction, the length A in the predetermined direction corresponds to the length of first surface 30*a* in the width direction. Note that also in the second embodiment, the predetermined direction may be the width direction of first surface 30*a* instead of the direction orthogonal to first surface 30*a*.

In addition, in the above-described first embodiment, heat exchanging unit 40 includes plate heat exchanger 30, high-temperature side heat exchanger 17, liquid receiver 16, spiral heat exchanger 22, low-temperature side dryer 24, and low-temperature side heat exchanger 27. Alternatively, heat exchanging unit 40 may be configured to include at least plate heat exchanger 30 and spiral heat exchanger 22. In other words, heat exchanging unit 40 may not include at least one of high-temperature side heat exchanger 17, liquid receiver 16, low-temperature side dryer 24, and low-temperature side heat exchanger 27. Note that heat exchanging unit 40 of the second embodiment may also be configured to include at least plate heat exchanger 30 and double-tube heat exchanger 122.

In addition, while, in the above-described first embodiment, heat insulating member 40*a* of heat exchanging unit 40 is formed to cover plate heat exchanger 30, high-temperature side heat exchanger 17, liquid receiver 16, spiral heat exchanger 22, low-temperature side dryer 24, and low-temperature side heat exchanger 27. Alternatively, heat insulating member 40*a* may be configured to not cover at least one of high-temperature side heat exchanger 17, liquid receiver 16, low-temperature side dryer 24, and low-temperature side heat exchanger 27. Note that heat insulating member 40*a* of heat exchanging unit 40 of the second embodiment may also be configured to not cover at least one of high-temperature side heat exchanger 17, liquid receiver 16, low-temperature side dryer 24, and low-temperature side heat exchanger 27.

In addition, while heat exchanging unit 40 is housed in rear side wall 3*a* of box 3 in the above-described embodiments, heat exchanging unit 40 may be housed in other side walls of box 3, such as the right side wall and/or left side wall of box 3. In this case, heat exchanging unit 40 is housed in the right side wall and/or left side wall such that the up-down direction of heat exchanging unit 40 is set along the up-down direction of freezer 2, and that the front side or rear side of heat exchanging unit 40 faces the right side or left side of freezer 2.

Figure 12:
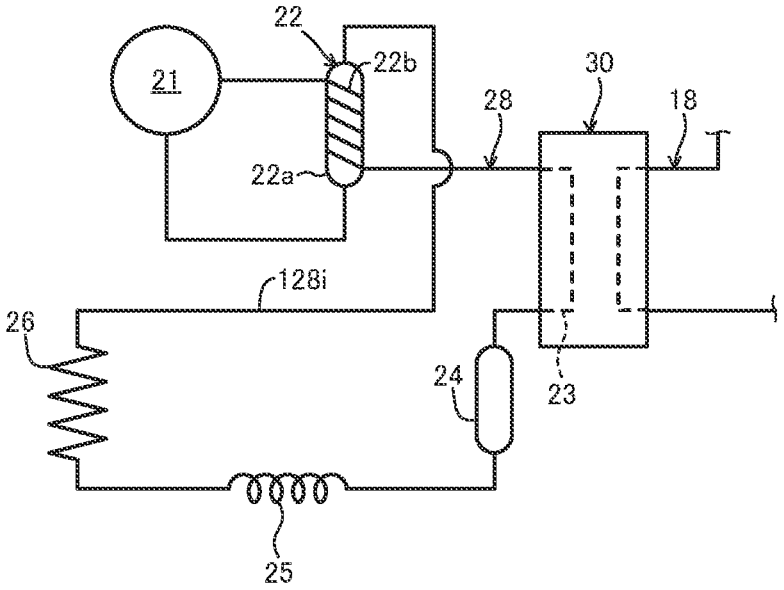
FIG. 12 is a schematic view illustrating a binary refrigeration apparatus of another modification of the first embodiment of the present disclosure.
Figure 13:
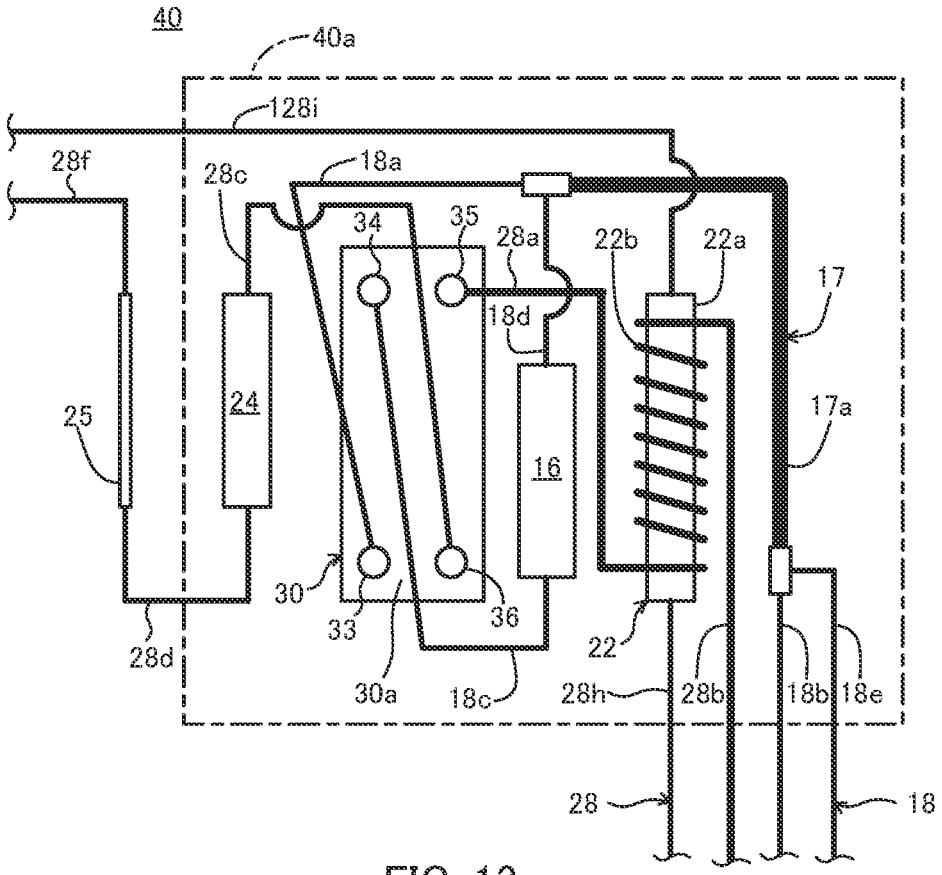
FIG. 13 is a diagram illustrating a configuration of a heat exchanging unit in the binary refrigeration apparatus illustrated in FIG. 11.

In addition, while low-temperature side refrigeration circuit 20 includes low-temperature side heat exchanger 27 in the above-described embodiments, low-temperature side heat exchanger 27 may not be provided. In this case, in low-temperature side refrigeration circuit 20 of the first embodiment, the low-temperature side refrigerant flows through low-temperature side compressor 21, spiral tube 22*b*, low-temperature side condenser 23, low-temperature side dryer 24, low-temperature side decompressor 25, low-temperature side evaporator 26, and main tube 22*a* in this order and returns back to low-temperature side compressor 21 as illustrated in FIG. 12. In this case, low-temperature side evaporator 26 and main tube 22*a* are connected at ninth low-temperature side pipe 128*i*. In addition, in this case, in heat exchanging unit 40, low-temperature side decompressor 25 may be disposed on the left side of plate heat exchanger 30 and low-temperature side dryer 24 without being covered by heat insulating member 40*a* as illustrated in FIG. 13. Note that in heat exchanging unit 40 of the second embodiment, ninth low-temperature side pipe 128*i* connects low-temperature side evaporator 26 and outer tube 122*b*.

In addition, while high-temperature side refrigeration circuit 10 includes high-temperature side heat exchanger 17 in the above-described embodiments (FIG. 1), high-temperature side heat exchanger 17 may not be provided. In this case, in high-temperature side refrigeration circuit 10 of each embodiment, the high-temperature side refrigerant flows through high-temperature side compressor 11, high-temperature side condenser 12, high-temperature side dryer 13, high-temperature side decompressor 14, high-temperature side evaporator 15 and liquid receiver 16 in this order and returns to high-temperature side compressor 11.

Figure 14:
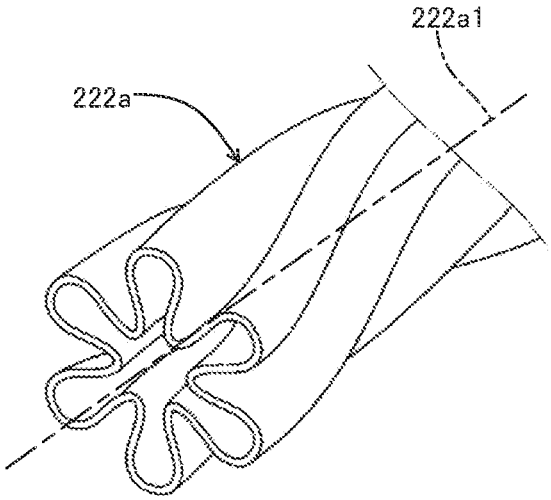
FIG. 14 is a perspective view schematically illustrating a multi-petal tube of a double-tube heat exchanger of a modification of the second embodiment of the present disclosure.

In addition, in the above-described second embodiment, the side wall of multi-petal tube 122*a* is formed such that the waveform in which peak 122*a*2 and valley 122*a*3 alternate in the circumferential direction extends straight along the direction of axis line 122*al*. Alternatively, as illustrated in FIG. 14, the side wall of multi-petal tube 222*a* may be formed such that the waveform spirals around axis line 222*al*. In this manner, the generation of the turbulent flow of the low-temperature side refrigerant at multi-petal tube 222*a* is further facilitated.

This application is entitled to and claims the benefit of Japanese Patent Application No. 2020-097933 filed on Jun. 4, 2020, the disclosure each of which including the specification, drawings and abstract is incorporated herein by reference in its entirety.

INDUSTRIAL APPLICABILITY

The binary refrigeration apparatus of the present disclosure is widely applicable to ultra-low-temperature freezers and refrigerators.

REFERENCE SIGNS LIST

1 Binary refrigeration apparatus
2 Freezer
3 Box
3*a* Rear side wall (Side wall)
3*d*1 Housing part
5 Lid member
5*a* Cover panel
5*b* First sheet
5*c* Heat insulating panel
5*d* Second sheet
10 High-temperature side refrigeration circuit
16 Liquid receiver
18 High-temperature side pipe (Pipe)
20 Low-temperature side refrigeration circuit
21 Low-temperature side compressor
22 Spiral heat exchanger
22*a* Main tube
22*b* Spiral tube
24 Low-temperature side dryer (Dryer)
28 Low-temperature side pipe (Pipe)
30 Plate heat exchanger
30*a* First surface
40 Heat exchanging unit
40*a* Heat insulating member
122 Double-tube heat exchanger
122*a*, 222*a* Multi-petal tube
122*a*1, 222*al* Axis line
122*b* Outer tube

The invention claimed is:

1. A binary refrigeration apparatus comprising:

a low-temperature side refrigeration circuit including a spiral heat exchanger including a main tube and a spiral tube wound around the main tube in a spiral form, the main tube being a tube where a low-temperature side refrigerant that flows into a low-temperature side compressor enters, the spiral tube being a tube where the low-temperature side refrigerant flown out from the low-temperature side compressor enters; and a high-temperature side refrigeration circuit where a high-temperature side refrigerant that exchanges heat with the low-temperature side refrigerant through a plate heat exchanger circulates, wherein the low-temperature side refrigerant flown out from the low-temperature side compressor as a whole enters the spiral tube.

2. The binary refrigeration apparatus according to claim 1, wherein the main tube is disposed such that a direction of an axis line of the main tube is set along an up-down direction; and wherein the spiral tube is wound such that the low-temperature side refrigerant flows from an upper side to a lower side of the main tube.

3. The binary refrigeration apparatus according to claim 1, wherein a portion where the low-temperature side refrigerant flows in the spiral tube is formed in a rectangular shape in cross section.

4. The binary refrigeration apparatus according to claim 1, further comprising a heat exchanging unit, wherein the heat exchanging unit includes the plate heat exchanger, the spiral heat exchanger, a high-temperature side heat exchanger, a liquid receiver, a low-temperature side dryer, a low-temperature side heat exchanger, and a pipe disposed at a periphery of the plate heat exchanger and the spiral heat exchanger, and wherein the heat exchanging unit is formed such that a length in a predetermined direction is suppressed.

5. The binary refrigeration apparatus according to claim 4, wherein the plate heat exchanger is formed in a cuboid shape;

wherein the pipe is connected to a first surface of the plate heat exchanger; and wherein the predetermined direction is a direction orthogonal to the first surface.

6. The binary refrigeration apparatus according to claim 4, wherein the plate heat exchanger is formed in a cuboid shape;

wherein the pipe is connected to a first surface of the plate heat exchanger; and wherein the predetermined direction is a width direction of the first surface.

7. The binary refrigeration apparatus according to claim 4, wherein the high-temperature side refrigerant flown out from the plate heat exchanger enters the liquid receiver, and the low-temperature side refrigerant flown out from the plate heat exchanger enters the low-temperature side dryer.

8. The binary refrigeration apparatus according to claim 4, wherein the heat exchanging unit is covered with a heat insulating member, and housed in a side wall of a box where the binary refrigeration apparatus is used, wherein the heat insulating member is formed of an urethane foam.

9. The binary refrigeration apparatus according to claim 1, wherein the low-temperature side compressor is directly connected to the spiral tube by a low-temperature side pipe.

10. A binary refrigeration apparatus comprising:

a low-temperature side refrigeration circuit including a double-tube heat exchanger including a multi-petal tube formed in a tubular shape with a wave shape in a cross section orthogonal to an axis line and an outer tube formed in a tubular shape for housing the multi-petal tube inside, the multi-petal tube being a tube where a low-temperature side refrigerant flown out from a low-temperature side compressor enters, the outer tube being a tube where the low-temperature side refrigerant that flows into the low-temperature side compressor enters between an inner peripheral surface of the outer tube and an outer peripheral surface of the multi-petal tube; and a high-temperature side refrigeration circuit where a high-temperature side refrigerant that exchanges heat with the low-temperature side refrigerant through a plate heat exchanger circulates.

* * * * *